United States Patent [19]

Pryor

[11] 4,264,419

[45] Apr. 28, 1981

[54] ELECTROCHEMICAL DETINNING OF COPPER BASE ALLOYS

[75] Inventor: Michael J. Pryor, Woodbridge, Conn.

[73] Assignee: Olin Corporation, New Haven, Conn.

[21] Appl. No.: 82,665

[22] Filed: Oct. 9, 1979

[51] Int. Cl.[3] ..... C25F 5/00

[52] U.S. Cl. ..... 204/146; 204/140

[58] Field of Search ..... 204/140, 146

[56] References Cited

U.S. PATENT DOCUMENTS

| | | | |
|---|---|---|---|
| 1,160,400 | 11/1915 | Goldschmidt | 204/146 |
| 3,617,456 | 11/1971 | Dillenberg | 204/146 |
| 3,826,724 | 7/1974 | Riggs, Jr. | 204/140 |
| 3,886,055 | 5/1975 | Baboian | 204/140 |
| 3,900,375 | 8/1975 | Baboian | 204/140 |
| 3,912,603 | 10/1975 | Mietens | 204/146 |

FOREIGN PATENT DOCUMENTS

| | | | |
|---|---|---|---|
| 744297 | 6/1970 | Belgium | 204/146 |

OTHER PUBLICATIONS

Metal Finishing, Nov., 1955, p. 66.

*Primary Examiner*—T. M. Tufariello
*Attorney, Agent, or Firm*—Paul Weinstein

[57] ABSTRACT

A method for electrochemically removing a tin layer from copper or copper alloy substrates without any attack on the substrate is disclosed which permits the simultaneous recovery of pure tin at high efficiency. The process is carried out by achieving effective complexing of tin ions in solution so that a stannous ion activity of greater than $10_{-4}$ gm ions/l is never achieved while conducting the electrochemical detinning potentiostatically at a potential where anodic corrosion of the copper or copper alloy substrate is not possible.

10 Claims, 5 Drawing Figures

ELECTROLYTE 1M NaCl
COPPER
TIN
+0.4
+0.2
0
-0.2
-0.4
-0.6
POTENTIAL (VOLTS) VS. SATURATED CALOMEL ELECTRODE
10-2
10-1
1
10
102
CURRENT DENSITY (ma/cm2)

ELECTROLYTE 0.5M CITRIC ACID + 0.5M SODIUM CITRATE
ALLOY C 66400
TIN
CURRENT DENSITY (ma/cm²)
10⁻²
10⁻¹
1
10
10²
POTENTIAL (VOLTS) VS. SATURATED CALOMEL ELECTRODE
+0.4
+0.2
0
-0.2
-0.4
-0.6
-0.8

ELECTROCHEMICAL DETINNING OF COPPER BASE ALLOYS

BACKGROUND OF THE INVENTION

This invention relates to electrolytic separation of metals and, more particularly, to an improved method for selectively removing an external tin layer of a copper or copper alloy substrate by controlled potential electrolysis utilizing a particular electrolyte solution.

Copper and copper alloy substrates are frequently tinned using various techniques to form metal composites, including hot dipping, electroplating, etc. so as to provide improved solderability shelf life and longer shelf life with respect to low contact resistance. Both during the composite forming processes and in fabrication of metal products from the metal composite stock, some amount of off-grade scrap composite metal is inevitably produced. It is highly desirable in order to conserve materials and to reduce costs to recover the components of the scrap composite and to reuse these components in further operations. Scrap from tinned copper and copper alloy substrates is frequently difficult to handle in a brass mill.

In certain instances, scrap can be consumed by remelting into tin containing alloys such as the phosphor bronzes and tin brasses. However, when the substrate alloy contains other alloying additions not permitted within the compositional range of the two above alloy families, then this most economical route for consumption of the tin scrap does not exist. Alloy C66400 containing nominally 11% zinc with iron and cobalt additions is a good example of this. Neither the zinc, iron nor cobalt can be tolerated within the impurity limits of the phosphor bronzes. The iron and cobalt cannot be tolerated within the compositional limits of the tin brasses except in cases where the tin scrap comprises only a small portion of the overall melt.

PRIOR ART STATEMENT

Chemical methods are known for removing both tin and solder from copper alloys. In the main, these chemical methods involve attack of the tin scrap by fluoroboric acid to which has been added a depolarizer to speed the overall chemical attack. Occasionally, sodium hydroxide has been used instead of fluoroboric acid at some sacrifice in stripping speed.

This particular prior art process for removing tin and solder suffers from several disadvantages. Fluorobic acid itself is basically an expensive chemical. Also, the life of the bath is controlled by depletion of the depolarizer. There is also some significant attack on the copper alloy substrate despite the fact that in some chemical baths corrosion inhibitors are added to minimize although not to eliminate this attack. In addition, it is not possible with reasonable economics to recover tin metal from a spent fluoroboric acid base solution. A tin salt can be recovered chemically, but this is contaminated with copper and the other alloying additions present in the substrate due to the fact that there is some attack on the copper alloy substrate. Finally, the fluorborate based solutions pose may problems from the standpoint of disposal.

While the above chemical method for removing tin is not excessively bad for hot dipped tin scrap, it is economically unreasonable to utilize such a process for removing electrochemical coatings of tin. Hot dipped tin coatings are quite quite thin, typically in the order of 20μ inches, and consist of a high percentage of intermetallics and very little metallic tin. Chemically recovery of tin in such coatings is not economically unreasonable. However, electrochemical coatings of tin are typically of a thickness greater than one order of magnitude than the thickness of hot dip coatings and, at least initially, consist of all metallic tin. Thus, it would be desirable to provide a process for economically and effectively removing this latter type of coating, consisting primarily of metallic tin.

The present invention provides an electrochemical method for removing metallic tin from tinned copper alloys which method is free from the foregoing objections. The process permits the use of a safe non-toxic solution, does not require a depolarizer and generates no attack whatsoever on the copper alloy substrate thereby permitting recovery of the tin in pure metallic form.

Various bath solutions are known in the prior art for electrolytically removing a first metal layer from a metal composite body. See for example the article "Finishing Pointers, Stripping of Tin From Copper-Base Alloys, " page 66, *Metal Finishing,* November, 1955, wherein use of sodium hydroxide, hydrochloric, sulfuric, fluroroboric and acetic acids are disclosed. It is also known to use solutions of a salt of thiocyanic acid (thiocynate) in the presence of water soluble phenol to strip layers of chromium, nickle or gold from copper or copper alloy substrates as exemplified in U.S. Pat. No. 3,617,456 to Dillenberg. U.S. Pat. No. 1,160,400 to Goldschmidt discloses the use of a mixture of stannate of soda and caustic soda, with an excess of the caustic soda, as an electrolyte for detinning. Finally, U.S. Pat. No. 3,912,603 to Mietens et al. discloses removing metallic coatings, such as nickel, chromium, zinc, tin, copper and cadmium from steel parts by utilizing a bath containing nitric acid and/or its salts with inorganic and/or organic bases, organic acids and/or their salts and a water soluble halogen compound.

U.S. Pat. No. 3,900,375 to Baboian is directed to a process for separating a first metal from a composite metal body wherein the first metal is adhered as an external layer over a substrate constituted by a second metal. The metal body is immersed in an electrolytic solution comprising an alkali metal cyanide in which the two metals are subject to differential anodic dissolution at a predetermined anode voltage measured by reference to a standard electrode. The process is disclosed as being utilized on a composite body constructed of palladium as the second metal and silver, gold, or an alloy of silver and gold as the first metal.

All prior art patents described herein are intended to be incorporated by reference.

SUMMARY OF THE INVENTION

The present invention is directed to a novel process for separating a first metal from a composite metal body and in particular, in which said first metal is a tin layer adhered as an external layer over a copper or copper alloy substrate. The composite body is immersed in an electrolytic citrate solution whereby effective complexing of tin ions is achieved such that a stannous ion activity of greater than about $10^{-4}$ gm ions/1 is never achieved. The process is conducted at constant potential, e.g. potentiostatically at a potential where anodic corrosion of the copper or copper alloy substrate is not possible.

In a further aspect of the invention optimum recovery of tin is achieved by addition of a colloidal substance, e.g. peptone, agar-agar, gelatin, etc. to the electrolyte solution.

It is an object of the present invention to provide a means for efficiently and economically recoverying the components of a metal composite and, more particularly, for recovery of a tin layer from a copper or copper alloy substrate.

It is also an object of this invention to accomplish such recovery rapidly, efficiently, and economically without significant attack, degradation or deterioration of the copper or copper alloy substrate.

DETAILED DESCRIPTION OF THE PREFERRED EMBODIMENTS

Figure 1:
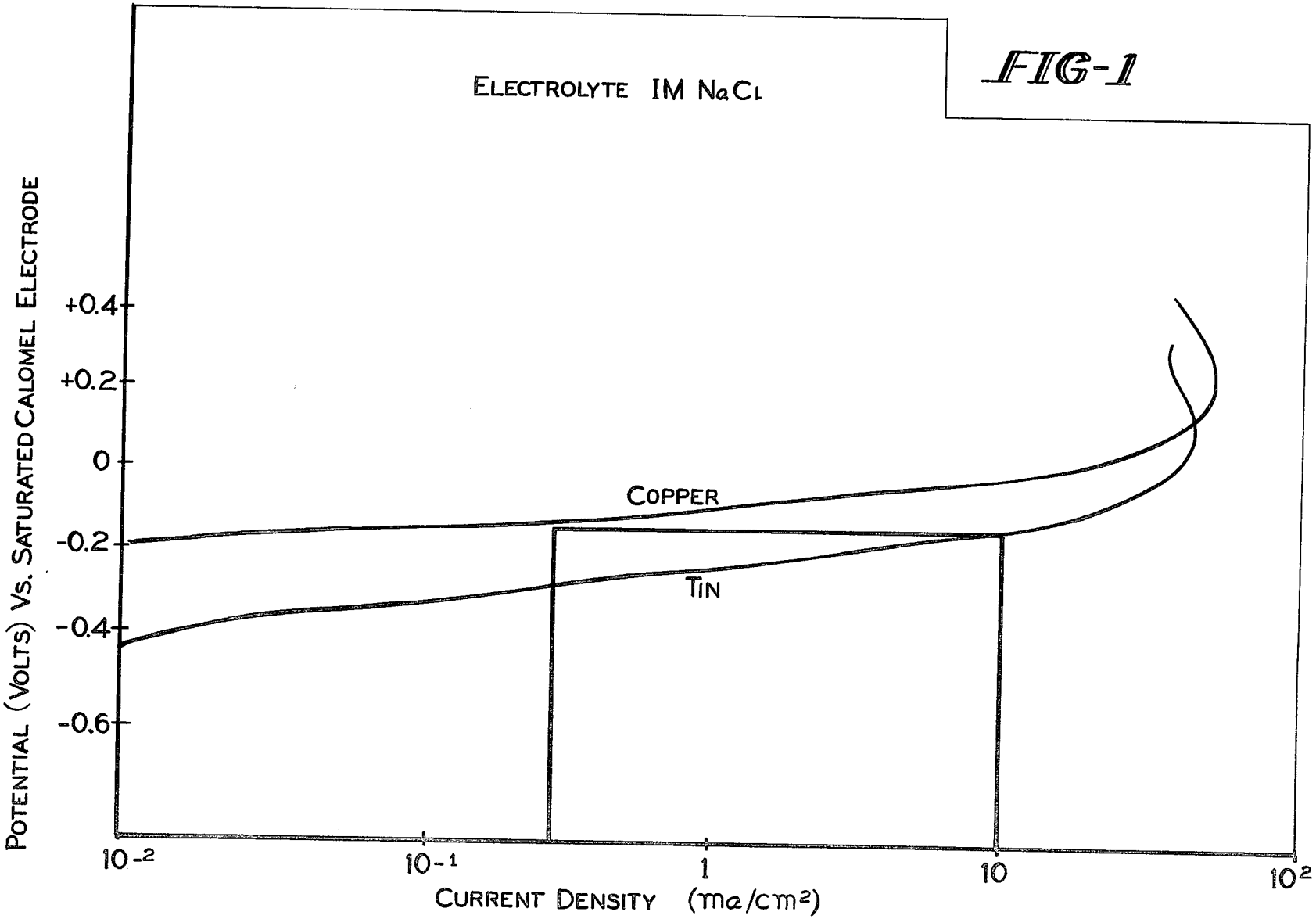
FIG. 1 is a graph illustrating aspects of an electrochemical detinning process showing the relationship between current density and potential when tin and copper are made anodes in a neutral salt, in this case 1 molar sodium chloride solution.
Figure 2:
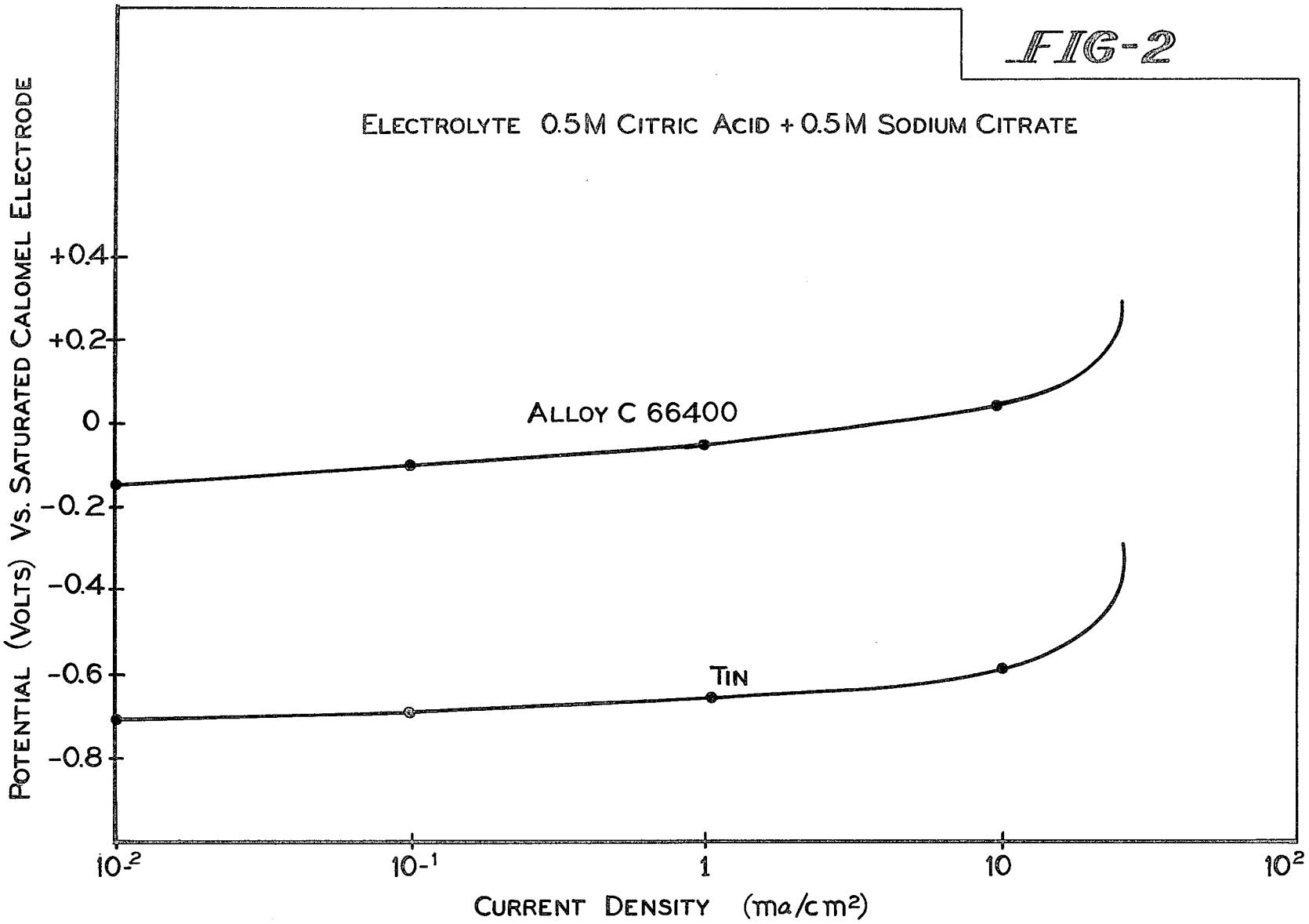
FIG. 2 is a graph illustrating aspects of the electrochemical detinning process of this invention showing the anodic polarization curves for metallic tin and alloy C66400 in electrolytes containing 0.5 molar citric acid and 0.5 molar sodium citrate dissolved in water.

One of the primary concepts of the electrochemical process in accordance with this invention is illustrated in FIGS. 1 and 2. FIG. 1 shows the relationship between current density and potential when tin and copper are made anodes in a neutral salt, in this case 1 molar sodium chloride solution. The half cell reaction $Cu + - Cu + + 2e$ has a standard potential of $+0.335$ volts on the standard hydrogen scale. The half cell reaction $Sn = Sn + + + 2e$ has a standard potential of $-0.126$ volts. Copper and its alloys take up a potential of around zero volts in this electrolyte with tin taking up a potential of around $-0.2$ volts. As both metals are made anodic and the anodic current density is increased, both potentials will move in the noble direction until the reaction becomes mass transport limited at a current density of around 40 ma/cm$^2$. Electrotinned copper will have a tin thickness generally ranging between 100–300 microinches. If this is to be removed rapidly by electrochemical means, relatively high current densities of the order of 10 ma/cm$^2$ are required. It may be seen from FIG. 1 that if such a current density is obtained in NaCl solution on the tin and tin is consumed electrochemically, it will still be possible to anodically corrode the copper and its alloying additions at an anodic current density of around 0.3 ma/cm$^2$. In other words, if a current density of 10 ma/cm$^2$ is applied to the tinned scrap, the tin will first be removed rapidly but after it is removed, the copper alloy substrate will also be anodically attacked, although at a somewhat lower current density; however, the solution will become contaminated with copper, and if it is an alloy, its alloying additions. Such a situation is clearly undesirable.

In order to provide a clear separation of metallic tin from a copper or copper alloy substrate, it is obvious that better separation is needed between the anodic polarization curves of the tin and of the copper or copper alloy substrate. This can be achieved provided that the stannous ion activity in the solution is maintained low by effectively complexing the stannous ions without simultaneously complexing the cupric ions.

An adequate separation between the two polarization curves can be obtained provided that the stannous ion activity in solution is maintained at a value below about $10^{-4}$ gram ions per liter. This is illustrated in FIG. 2 which shows the anodic polarization curves for metallic tin and copper alloy C66400 in electrolytes containing 0.5 molar citric acid and 0.5 molar sodium citrate dissolved in water. Comparing FIG. 2 to FIG. 1, it may be seen that the copper alloy anodic polarization curve is little changed by the use of the citrate electrolyte. However, the tin anodic polarization curve is depressed to much lower values due to the highly efficient complexing action of the citrate ion, wherein effect the stannous ion activity is in the vicinity of $10^{-11}$ gram ions/1. It may be seen from FIG. 2 that if 10 ma/cm$^2$ is applied to the tin, it will dissolve at a potential of about $-0.6$ volts. If the potential is held at this value, there is no possibility of anodic corrosion of the alloy C66400.

It is important in accordance with an intimately related concept of this invention that during electrochemical detinning primary control must be exerted over the potential at which the electrotinned scrap is held during electrochemical detinning. Prior art processes for electrochemical detinning feature either control of the cell voltage or control of the total current flowing within the electrochemical cell. The situation when the potential of the electrotinned scrap is held at $-0.6$ volts and the cathode potential is permitted to float will be compared with the situation where the current flowing in the overall cell is held constant at 10 ma/cm$^2$. In the first case, which is a potentiostatic process, the tin will corrode anodically until it is consumed. The potential of the detinned scrap will still remain at $-0.6$ volts where anodic corrosion of the copper alloy substrate is not possible. Since no anodic corrosion of the copper alloy substrate is possible, the current in the cell will decay to zero (FIG. 3) and provide a positive "end point" for the process. Since no anodic corrosion of the copper alloy substrate occurs, any tin recovered at the cathode will be in pure metallic form.

Let us now illustrate the important differences between the above situation and art electrochemical process involving control of cell voltage or control of cell current.

If the voltage across the electrochemical cell is held constant, both the potentials of the anode (tinned scrap) and cathode can and will vary, but they must vary together so that their difference is constant. If the voltage is set to effectively strip tin, even in the presence of a complexing agent, what will happen is that the tin will first be removed and deposited in the cathode. However, as the copper substrate is partly exposed, the potential of the anodic tinned scrap will move gradually in the more noble direction thereby resulting in the anodic dissolution of the copper alloy. The potential of the cathode will move simultaneously in the same direction thereby reducing the current and, therefore, the cathodic plating speed. This occurs as a consequence of maintaining constant cell voltage. However, the current decrease will be small, the substrate will be continually consumed, and the deposited tin on the cathode will be progressively contaminated with copper and the reducible alloying additions in the substrate alloy. Voltage control, therefore, lacks a clear end point and lacking this must produce contaminated tin as a cathodic deposit and unnecessary wastage of the substrate copper alloy.

The situation with respect to controlling cell current is even worse. As soon as the copper substrate is exposed locally, the cathode potential will start to rise and permit anodic dissolution of copper. The cathode potential will rise but less than in the case of voltage control so as to permit maintenance of constant current. With a small separation between the tin and copper anodic potentials, voltage monitoring will not provide an adequate end point for stripping, and so contaminated cathodic deposits and substrate wastage both occur.

In order to eliminate these problems, potentiostatic control of the anode (scrap) potential in combination with complexing the stannous ions is highly advantageous since all of the foregoing problems are eliminated, and a positive self-limiting end point is provided by monitoring current.

The two key factors of the instant invention, therefore, are as follows: one, effective complexing of tin ions in solution is achieved so that a stannous ion activity of greater than about $10^{-4}$ gm ions/l is never achieved, and two, electrochemical detinning is conducted at constant potential of the anode, e.g. potentiostatically at a potential where anodic corrosion of the copper alloy substrate is not possible.

Figure 5:
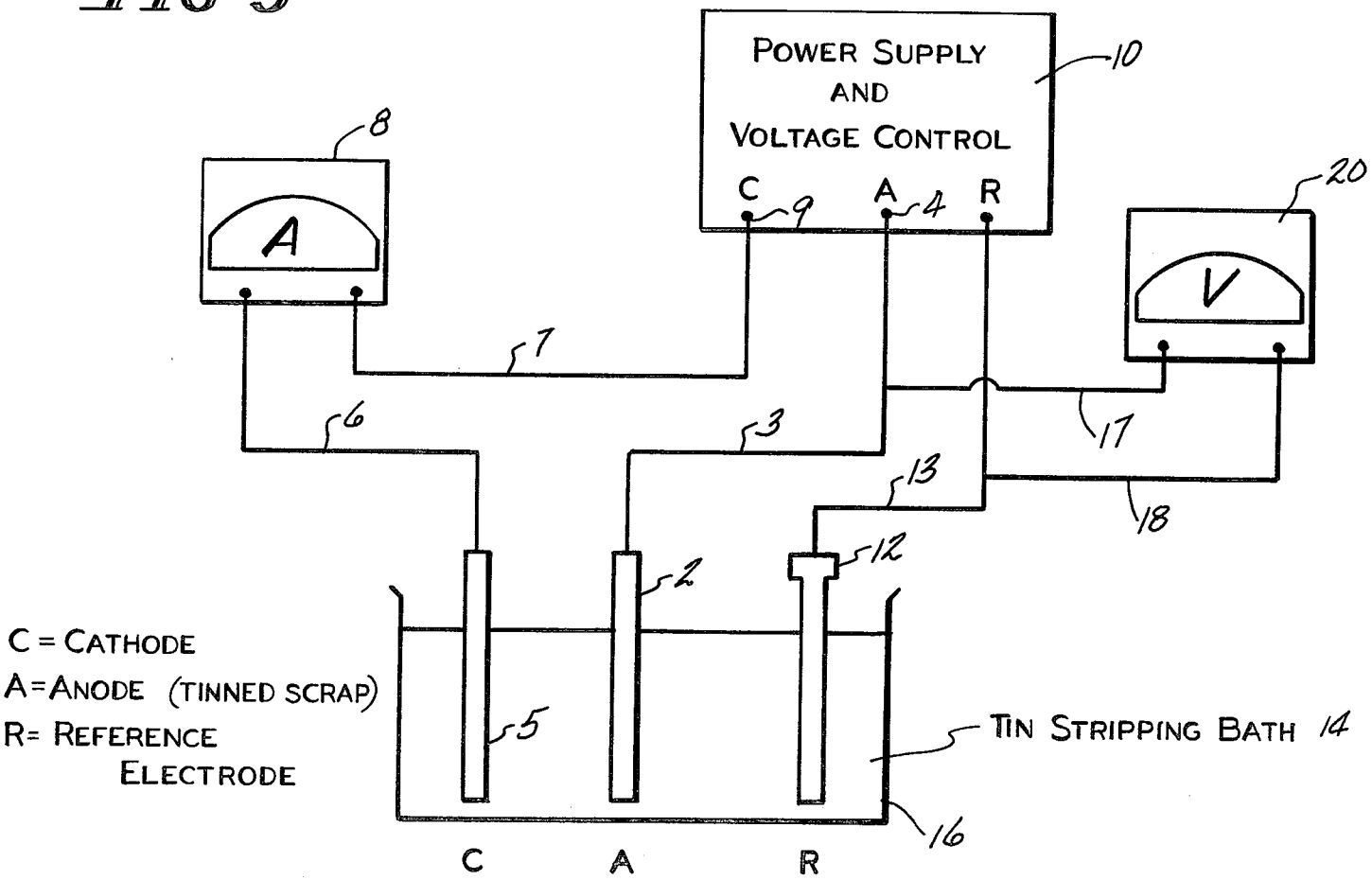
FIG. 5 is a schematic diagram of an apparatus for carrying out the process of this invention.

Apparatus for carrying out the process of this invention is illustrated in FIG. 5. Anode 2, consisting essentially of tinned scrap, is connected via lead wire 3 to the positive terminal 4 of a power supply and voltage control device 10. Negative terminal 9 of power supply and voltage device 10 is connected via lead wires 6 and 7 through current meter 8 to the cathode 5. A reference electrode 12 is shown immersed in tin stripping bath 14 along with the cathode 5 and the anode 2 and is utilized to sense the voltage of anode 2. Reference electrode 12 is connected to power supply and voltage control device 10 via lead wire 13. Potential meter 20 is connected across lead wires 3 and 13 via lead wires 17 and 18 and provides a signal corresponding to a difference in voltage between anode 2 and reference electrode 12. The tin stripping bath 14 is maintained within the container 16. Thus, current meter 8 enables monitoring of the current, while potential meter 20 enables the carrying out of potentiostatic control of the anode (scrap) 2 via voltage control device 10. This control system can thus be utilized in combination with complexing of the stannous ions in tin stripping bath 14 to carry out the process of this invention.

Figure 3:
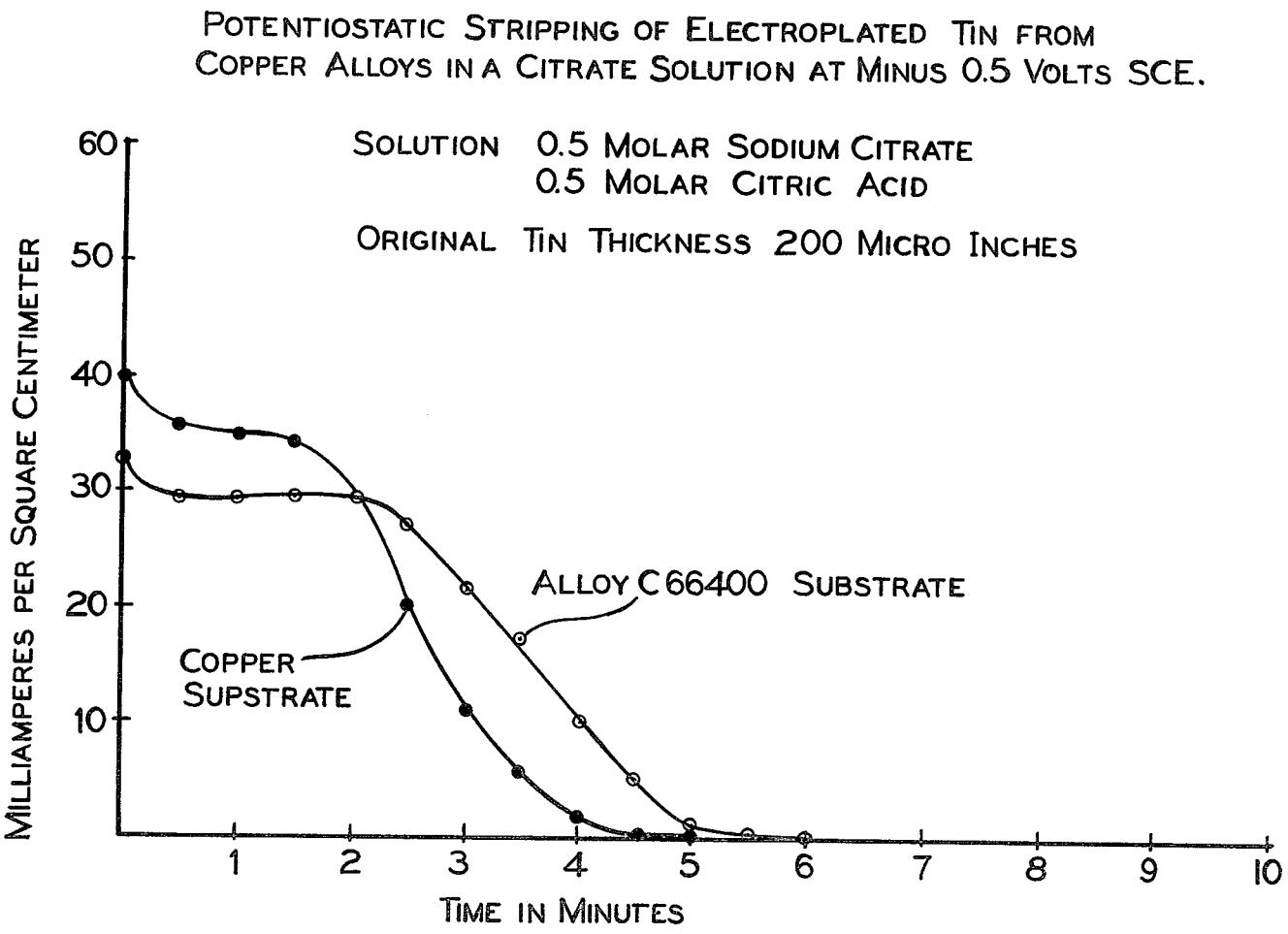
FIG. 3 is a graph showing the results of conducting a potentiostatic stripping of electrotinned alloy C66400 in accordance with the process of the present invention.

Results of conducting a potentiostatic stripping of samples of electrotinned copper and alloy C66400 in accordance with the process of this invention are shown in FIG. 3. The process was carried out using a 0.5 molar sodium citrate and 0.5 molar citric acid solution at 25° C. on specimens which had a metallic tin thickness of 200 microinches. The potential of the electrotinned alloy C66400 and electrotinned copper specimen was held at −0.5 volts vs. Saturated Calomel Electrode (SCE), and the current density was measured as a function of time. Initially high current densities in the range of 30–40 ma/cm$^2$ were obtained as the tin was being anodically corroded at high efficiency. Thereafter, the current density decreased rapidly with time and finally terminated after about six minutes after which time removal of the tin from the substrate was complete. Inasmuch as there was no current flow after the removal of the tin, there was no anodic attack on the copper substrate.

A relatively substantial amount of tin passes into solution as the citrate complex during the removal of tin metal from the copper and alloy C66400 substrates. The potentiostatic process involves making the tinned copper an anode and fixing its potential at −0.5 volts versus SCE relative to a calomel electrode which was placed in the solution. A total current, less than $10^{-10}$ amperes, passes in the circuit between the reference electrode and the tinned copper or tinned alloy C66400 anode. The cell is also provided with a cathode. The potential of the cathode floats and is dependent on the amount of tin complex in solution. It is the current density flowing between the anode and the cathode that is measured in FIG. 3.

Figure 4:
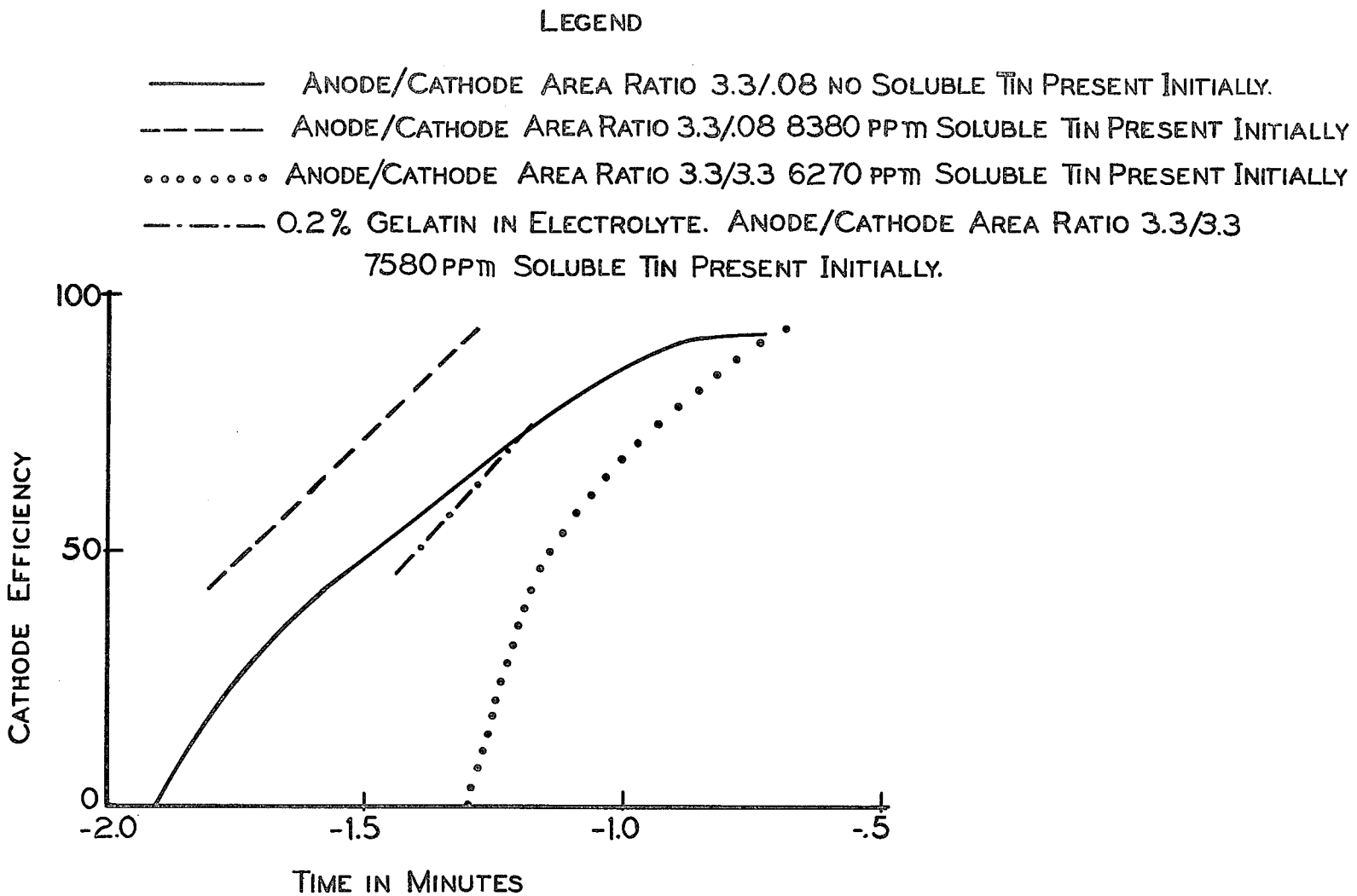
FIG. 4 is a graph showing the plot of relationships between cathode efficiencies and polarized cathode potentials for various anode/cathode ratios and soluble tin content, showing in addition such a relationship for an electrolyte in accordance with this invention having a 0.2% gelatin content.

As tin accumulates as stannous ion and as the citrate complex in solution, it will begin to plate out on the cathode particularly as its potential rises. The efficiency of plating increases with a shift of the potential of the cathode in the noble direction, i.e. tin species accumulating in solution. It is possible to recover tin after a short period of time with 100% efficiency after a small amount has accumulated in solution. However, the nature of the tin deposit for remelting is undesirable. It grows as a result of the low stannous ion concentration present in equilibrium with the much higher tincitrate complex ions in a dendritic fashion thereby providing the opportunity to trap electrolyte within the growing dendrites. It has been found that for optimum recovery of the tin, it is desirable to add to the solution a colloidal substance which acts to suppress dendritic crystal growth and favors compact metal disposition. Generically, these additions are called "brighteners" in electroplating. These brighteners are colloidal materials such as peptone, agar-agar, gelatin, etc.; the addition of about 0.2 wt.% gelatin, for example, to the sodium citrate-citric acid solution will provide a smooth disposition of tin at an efficiency of recovery of about 80%. See FIG. 4. The tin deposit at 80% current efficiency in the presence of 0.2% gelatin was smooth, compact, contained no liquid and had no copper or alloying additions of alloy C66400. It is of course possible to remove the remaining 20% of the tin from the electrolyte by subsequent treatment with an auxiliary cathode.

The advantages of the use of the process and electrolytic solution of this invention relative to the chemical removal of tin from tinned copper and copper alloys are as follows: under the conditions specified hereinabove, there is no attack of the copper or copper alloy substrate whatsoever; tin is recovered as part of the process as elemental tin of high purity due to the absence of attack on the copper or copper alloy substrate; the bath life is extremely long because no components of the bath are consumed during the potentiostatic stripping process, the depolarizing action of the chemical solution being provided by the flow of electric current in the system; and the citrate solutions utilized in the process are non-toxic and are easily disposed of.

In accordance with the process of this invention, the maximum stannous ion activity required to provide adequate separation of the anodic polarization curves has been defined as about $10^{-4}$ gm ions/1. Citrates are not the only solutions that can be used to achieve this complexing of the stannous ions. Other solutions include hydrofluoric acid, fluoroboric acid or salts of these acids. Tartrates will also work in the process of this invention and have the same advantage as the citrates.

The concentration of the citrates is not critical provided that high electrolytic conductivity is obtained in the solution. Equal quantities of sodium citrate and citric acid are preferred because the system is best buffered under these conditions. Both components, however, will work individually in the process of this invention.

The temperature at which the potentiostatic stripping process of this invention is conducted is not critical, but room temperature is preferred.

It is apparent that there has been provided with this invention a novel process for providing clear separation by electrochemical removal of metallic tin fromm a copper or copper alloy substrate without any attack on the substrate and with simultaneous high efficiency recovery of pure tin which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A process for electrochemically detinning a composite body, said body comprising a layer of tin adhered to a copper or copper alloy substrate, the process comprising the steps of:

providing an aqueous electrolyte solution consisting essentially of at least one stannous ion complexing substance in a concentration adapted to maintain a maximum stannous ion activity in said solution of less than about $10^{-4}$ gm ions/1;

immersing said substrate in said solution;

supplying current to said body from the positive terminal of a power source whose negative terminal is connected to an electrode immersed in said solution thereby establishing an electrolytic circuit in which said substrate is the anode and said electrode is the cathode; and controlling the voltage of said anode relative to a standard electrode so that the electrochemical detinning is conducted at a substantially constant anode potential which is selected such that anodic corrosion of said tin layer occurs but anodic corrosion of said copper or copper alloy substrate is not possible.

2. A process as set forth in claim 1 wherein the voltage of said anode is maintained at a level between about −0.7 and −0.4 volts relative to a saturated calomel electrode.

3. A process as set forth in claim 1 wherein said at least one stannous ion complexing substance consists essentially of one or more substances selected from the group consisting of citric acid, citrates, hydrofluoric acid and its salts, fluorobic acid and its salts, and tartrates.

4. A process as set forth in claim 1 wherein said at least one stannous ion complexing substance consists of sodium citrate.

5. A process as set forth in claim 1 wherein said at least one stannous ion complexing substance consists of a mixture of citric acid and sodium citrate.

6. A process as set forth in claim 1 wherein said solution consists essentially of about 0.5 molar citric acid and about 0.5 molar sodium citrate.

7. A process as set forth in claim 6 wherein the voltage of said anode is maintained at a level between about −0.6 and −0.5 volts relative to a saturated calomel electrode.

8. A process as set forth in claims 1 or 5 wherein said solution contains at least one colloidal substance.

9. A process as set forth in claim 8 wherein said at least one colloidal substance is selected from the group consisting of peptone, agar-agar, and gelatin.

10. A process as set forth in claim 9 wherein said solution contains about 0.2 wt.% gelatin.

* * * * *